United States Patent [19]

Mori et al.

[11] 4,219,312

[45] Aug. 26, 1980

[54] VOLUME CONTROL SYSTEM FOR COMPRESSOR UNIT

[75] Inventors: Hidetomo Mori; Shingo Ishizawa, both of Ebina, Japan

[73] Assignee: Hitachi, Ltd., Japan

[21] Appl. No.: 952,986

[22] Filed: Oct. 20, 1978

[51] Int. Cl.[2] ..... F04B 49/02; F04B 49/06; F04B 49/08

[52] U.S. Cl. ..... 417/295; 417/302

[58] Field of Search ..... 417/295, 299, 309, 310, 417/302, 303, 505

[56] References Cited

U.S. PATENT DOCUMENTS

| | | | |
|---|---|---|---|
| 2,234,488 | 3/1941 | Dick | 417/295 |
| 3,367,562 | 2/1968 | Persson et al. | 417/295 |
| 3,448,916 | 6/1969 | Fraser | 417/295 X |

FOREIGN PATENT DOCUMENTS

| | | | |
|---|---|---|---|
| 1944841 | 5/1970 | Fed. Rep. of Germany | 417/295 |

*Primary Examiner*—Richard E. Gluck

*Attorney, Agent, or Firm*—Craig & Antonelli

[57] ABSTRACT

In a compressor unit of a type wherein the ratio of delivery pressure relative to intake pressure, i.e., pressure ratio, is required to be as uniform as possible during unloaded and loaded operating conditions, as is in screw compressors of dry type, solenoids are used to drive an intake throttle valve and a pressure relief valve in such a manner that, when the throttle valve is closed, the pressure relief valve is opened to avoid an increase of the pressure ratio. When signals are produced to close the throttle valve and open the pressure relief valve, the solenoids are instantanously operative to close the throttle valve and open the pressure relief valve.

5 Claims, 3 Drawing Figures

VOLUME CONTROL SYSTEM FOR COMPRESSOR UNIT

BACKGROUND OF THE INVENTION

1. FIELD OF THE INVENTION

The present invention relates to a volume control system for a compressor unit of the type wherein it is not permissible that the ratio of delivery pressure relative to intake pressure during a partly loaded operation, i.e., pressure ratio, is considerably differentiated from the pressure ratio during normal loaded operation. An example of this type of compressor is a screw compressor of the dry type.

2. DESCRIPTION OF THE PRIOR ART

The dry type screw compressor comprises a pair of screw rotors disposed in a housing in non-contact relationship with each other. No oil is fed into the housing during operation. In this type of compressor, if the compressor is controlled such that the intake flow is throttled while the compressor is subjected to the same delivery pressure, as is in an oil-injection type screw compressor, the intake pressure becomes close to a partial vacuum with a result that the pressure ratio is extraordinarily increased. In addition, the dry type screw compressors are not sufficiently cooled to avoid undue rise of the delivery temperature, which would cause accidental contact or sticking between screw rotors themselves or between the rotors and the housing due to the thermal expansion of the rotors. Thus, a volume control method has been employed for the dry type screw compressor, wherein the intake flow is throttled and simultaneously the delivery port is open to the atmosphere so as to eliminate the increase of the pressure ratio.

However, if the intake flow is completely stopped, the pressure ratio will become unduly high. Thus, another control has been proposed wherein the intake flow is not completely stopped but a small amount of gas is admitted into a compressor to restrain the increase of pressure ratio as much as possible. Such a control method and a system used to carry out the method are disclosed in U.S. Pat. No. 3,367,562. The control system disclosed in the U.S. Pat. has problems which will be discussed hereunder.

A hydraulic actuator comprising a housing (27) and a diaphragm (26) is employed to open a throttle valve (6) and close a pressure relief valve (22) and to keep these valves in these positions.

In loaded operating condition of the compressor unit, the pressure relief valve (22) is subjected to the delivery pressure of the high-pressure compressor (3) through a conduit (17). The force produced by this delivery pressure is of a considerable magnitude. This force could be reduced by reducing the diameter of the pressure relief valve (22). However, if the valve diameter were reduced, the resistance to the flow of the gas through a valve seat of a correspondingly reduced diameter will be correspondingly increased, so that the power to drive the compressors (2) and (3) cannot be reduced even during unloaded operation.

The diaphragm (26) divides the interior of the housing (27) into two chambers (28) and (29). The maximum pressure in the second chamber (29) will be equal to the delivery pressure of the high-pressure compressor (3) (with the compressor unit disclosed in U.S. Pat. No. 3,367,562, the pressure in the second chamber is equal to the delivery pressure of the low-pressure compressor (2). Considering the fact that leakage through the pressure relief valve (22) when in its closed position, i.e., during loaded operation of the compressor unit, must be avoided, the inner diameter of the housing (27) of the hydraulic valve actuator must be at least as large as from 2 to 3 times of the diameter of the valve (22). Thus, a large-sized valve actuator is required.

The use of a fluid pressure to operate the throttle valve (6) and the pressure relief valve (22) disadvantageously involves a substantial time delay from the moment when a pressure-sensitive switch actuator (77) associated with a gas reservoir or tank (14) emits a signal to the moment when the throttle valve (6) is open and the pressure relief valve (22) is closed or vice versa. Accordingly, the pressure in the tank (14) will be considerably varied from a level below a predetermined lower limit set by the switch actuator (77) to a level above a predetermined upper limit set by the actuator. The compressor unit control system disclosed in the U.S. Patent, therefore, fails to provide a good response and thus causes an unduly high power consumption.

The throttle valve (6) and the pressure relief valve (22) are linked by a rod (24). Thus, the pressure relief valve (22) is required to be disposed at a place near to the throttle valve. Consequently, the length of the pressure relief pipe (17) is increased with a resultant increase in the resistance of the pipe to the flow of the pressurized gas discharged therethrough during an unloaded operation of the compressor unit. The increase in the length of the pressure relief pipe (17) also has direct and indirect problems that the choice of the places at which a silencer and cooler (19), an intercooler (9), an after cooler (13), the air tank (14), etc. of the compressor unit is considerably limited.

SUMMARY OF THE INVENTION

It is an object of the present invention to provide a volume control system for a compressor unit in which intake throttle valve and pressure relief valve can be opened and closed in an extremely shortened time period.

It is another object of the present invention to provide a volume control system of the class specified above and which requires a reduced amount of power consumption.

It is a further object of the present invention to provide a volume control of the class specified above and in which the places of machine components can be substantially freely selected.

It is a still further object of the present invention to provide a volume control system for a compressor unit which has a simplified structure and achieves the objects pointed out above.

The improved volume control system for a compressor unit according to the present invention is characterized by a first spring means operative to bias a throttle valve toward its closed position, a first solenoid means operative when energized to move the throttle valve to its fully open position against the first spring means, link means between the throttle valve and the first solenoid means, a second spring means operative to bias a pressure relief valve toward its fully open position, a second solenoid means operative when energized to move the pressure relief valve to its closed position against the second spring means, an electric circuit for the second solenoid, an electric switch in the electric circuit, and a switch actuator means responsive to change-over of the positions of the throttle valve to actuate the electric switch, the arrangement being such that, when the throttle valve is moved to its closed position, the pressure relief valve is opened, and such that, when the throttle valve is moved to its open position, the pressure relief valve is closed.

The above and other object, features and advantages of the present invention will become more apparent from the following description with reference to the accompanying drawings.

DESCRIPTION OF PREFERRED EMBODIMENTS

Figure 1:
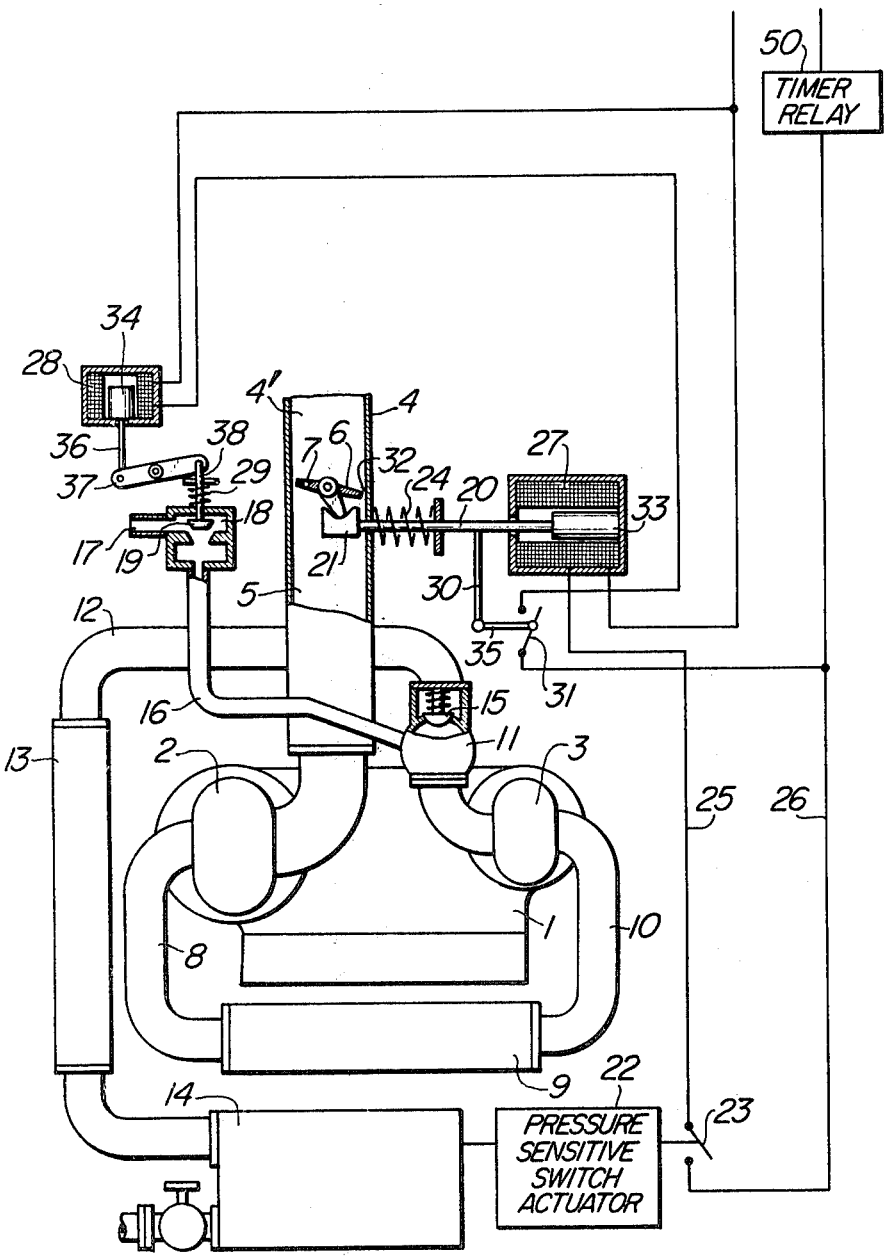
FIGS. 1 to 3 are partly sectional diagrammatic illustrations of first to third embodiments of a volume control system for a compressor unit according to the present invention, respectively.

Referring first to FIG. 1 showing a first embodiment of the invention, a low-pressure compressor 2 and a high-pressure compressor 3, both of which are screw compressors, are mounted on a casing 1. These compressors 2 and 3 are driven by a common shaft (not shown) mounted in the casing 1. An intake throttle valve 6 having an orifice 7 formed therein is disposed in an air intake pipe 4 connected to an intake port of the low-pressure compressor 2 and divides the intake pipe 4 into an upstream section 4' and a downstream section 5. When the throttle valve 6 is in its closed position, air flows from the upstream section 4' into the downstream section 5 through a gap 32 between the inner peripheral surface of the intake pipe 4 and the outer peripheral edge of the throttle valve 6 and through the orifice 7. However, when the throttle valve 6 is in its open position, air can freely flow from the upstream section 4' to the downstream section 5.

A delivery port of the low-pressure compressor 2 is connected to an intake port of the high-pressure compressor 3 through a pipe 8, an intercooler 9 and a pipe 10. To a delivery port of the high-pressure compressor 3 is connected a delivery pipe 11 which in turn is connected to a second delivery pipe 12. The delivery pipe 12 in turn is connected to an air tank 14 through an aftercooler 13.

The air delivered from the low-pressure compressor 2 at an intermediate pressure is introduced into the intercooler 9 through the pipe 8 and then into the high-pressure compressor 3 through the pipe 10. The compressed air discharged from the high-pressure compressor 3 is delivered to the tank 14 through the delivery pipes 11 and 12 and through the aftercooler 13.

At the junction between the delivery pipes 11 and 12 is disposed a check valve 15 which is adapted to interrupt the communication between the delivery pipes 11 and 12 when the valve 15 is closed thereby to prevent the compressed air in the tank 14 from flowing therefrom back toward the compressor 3 when the compressors 2 and 3 are stopped or unloaded.

A pressure relief pipe 16 is connected to the delivery pipe 11 and communicated with a valve chamber 18 which in turn is connected to a downstream relief pipe 17 open to the atmosphere. A pressure relief valve 19 is provided in the valve chamber 18 to control the communication between the upstream and downstream relief pipes 16 and 17.

The throttle valve 6 is connected through a member 21 to one end of a rod 20 the other end of which is connected to an iron core 33 surrounded by a first solenoid 27. A spring 24 is provided around the rod 20 to bias the latter in a direction to close the throttle valve 6.

The relief valve 19 is connected through a rod 38 and a lever 37 to one end of a rod 36 which in turn is connected at the other end to a second iron core 34 which is surrounded by a second solenoid 28. The electric circuit for the solenoid 28 includes therein a switch 31 adapted to be opened and closed by link members 30 and 35 which are operatively connected to the rod 20. A spring 29 is so asssociated with the rod 38 as to bias the latter in a direction to open the relief valve 19.

The tank 14 is provided with a pressure-sensitive switch actuator 22 which is adapted to open and close a switch 23 disposed between electric conductors 25 and 26. The solenoid 27 is connected in series to the switch 23 through the electric conductor 25.

In operation, a conventional timer relay 50 keeps the electric conductors electrically cut off from the power supply source until the speed of the motor (not shown) for the compressors 2 and 3 is increased up to a predetermined full speed. In this state, the throttle valve 6 and the relief valve 19 are positioned in their closed position and open position as shown in FIG. 1, respectively, due to the biasing forces of the springs 24 and 29, so that the compressors are driven in unloaded conditions. After the electric conductors 25 and 26 are supplied with electric current, if the pressure in the tank 14 is lower than a level which is predetermined by the pressure-sensitive switch actuator 22, the switch 23 is closed by the actuator 22. Consequently, the solenoid 27 is energized to move the iron core 33 and, thus, the rod 20 leftward against the force of the spring 24 thereby to rotate the throttle valve 6 toward its fully-open position. When the throttle valve 6 is rotated almost to its fully-open position by the leftward movement of the rod 20, the switch 31 is closed by the members 30 and 35, so that the solenoid 28 is energized to lift the iron core 34 together with the member 36. As a result, the lever 37 is rotated clockwise to lower the rod 38 against the biasing force of the spring 29. Consequently, the relief valve 19 is closed to render the compressors 2 and 3 loaded.

When the pressure in the tank 14 rises up to the upper limit set by the switch actuator 22, the switch 23 is opened to deenergize the solenoid 27, so that the rod 20 is moved rightward by the force of the spring 24 thereby to move the throttle valve 6 to the closed position. As the rightward movement of the rod 20 is commenced, the switch 31 is also opened to deenergize the solenoid 28, so that the spring 29 moves the relief valve 19 to its open position whereby the compressors 2 and 3 are unloaded.

In the illustrated embodiment of the invention, a relatively small magnitude of power will be sufficient to operate the throttle valve 6 due to the presence of the gap 32 around the valve 6. Therefore, the solenoid 27 is required only to exert a small magnitude of force which is necessary and sufficient to overcome the biasing force of the spring 24. In addition, a commercially available solenoid valve of the type that is closed when electrically energized can conveniently be used as an assembly of the solenoid 28 and the relief valve 19.

Figure 2:
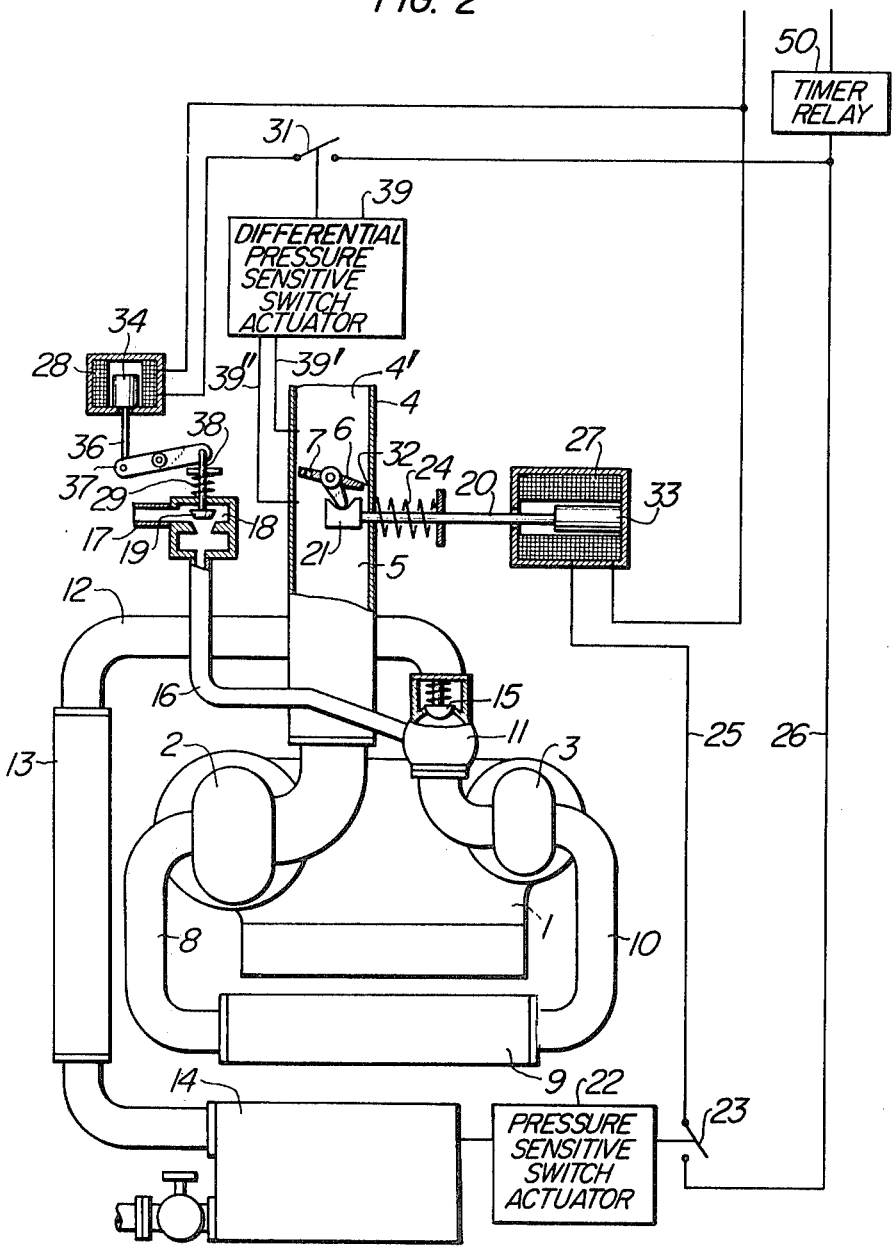

A second embodiment of the invention is illustrated in FIG. 2 wherein parts similar to those of the first embodiment are designated by similar reference numerals. The difference only will be discussed hereinafter. The switch 31 for opening and closing the electric circuit for the solenoid 28 is actuated by a differential pressure sensitive switch actuator 39 which is sensitive to a difference in pressure between the upstream and downstream sections 4' and 5 of the intake pipe 4. The switch actuator 39 is pneumatically connected to the upstream and downstream sections 4' and 5 of the intake pipe 4 by pressure transmitting conduits 39' and 39'', respectively. The switch actuator 39 is arranged such that, when the throttle valve 6 is in the fully-opened position with the pressure differential across the throttle valve 6 being substantially zero (0), the switch 31 is kept closed , and such that, when the throttle valve 6 is slightly moved from the fully-open position to a partly closed position to produce a pressure differential across the throttle valve, the switch 31 is opened.

In operation, the throttle valve 6 and the relief valve 19 are in the illustrated positions when the compressors 2 and 3 are just started. After the electric conductors 25 and 26 are supplied with electric current, the volume control of the compressors is carried out in accordance with the pressure in the tank 14. More specifically, if the pressure in the tank 14 is at a level below a lower limit of the pressure level determined by the switch actuator 22, the switch 23 is closed to cause the solenoid 27 to be energized, so that the throttle valve 6 is opened. When the throttle valve 6 is opened, the actuator 39 operates to close the switch 31, so that the solenoid 28 is energized to close the relief valve 19, whereby the compressors 2 and 3 are brought into loaded operations thereby to charge the tank 14 with compressed gas.

When the upper limit of the pressure determined by the pressure sensitive switch actuator 22 is reached in the tank 14, the actuator 22 operates to open the switch 23 to close the throttle valve 6. The differential pressure sensitive switch actuator 39 operates in response to a pressure difference produced across the closed throttle valve 6 to open the switch 31, so that the relief valve 19 is opened to render the compressors 2 and 3 unloaded.

Figure 3:
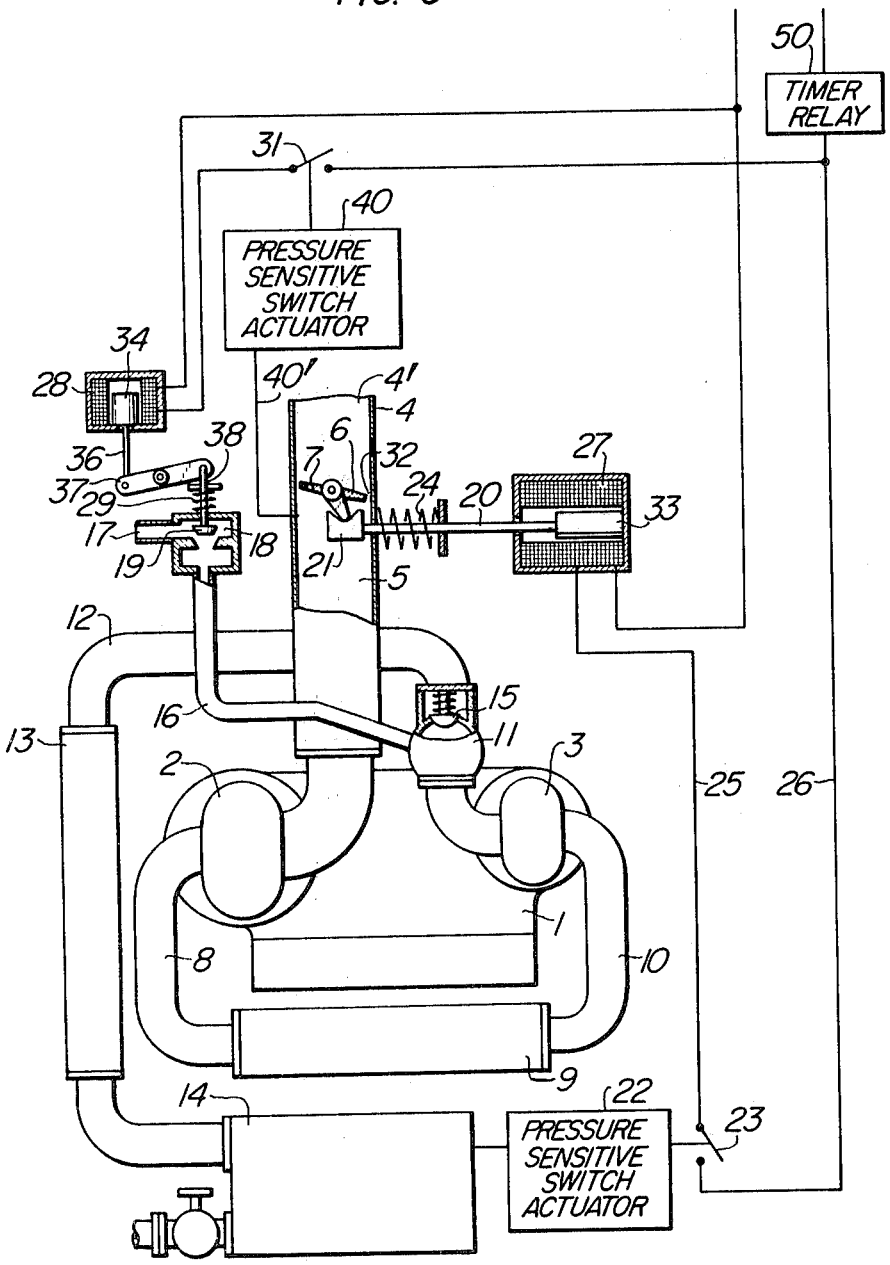

In the embodiment shown in FIG. 2, the switch 31 is opened and closed by the differential pressure sensitive switch actuator 39. However, the actuator for the switch 31 is not limited to the differential pressure sensitive type and may be replaced by another type of switch actuator. For instance, in the case where the pressure in the intake pipe 4 upstream of the throttle valve 6 is kept at a substantially constant level, as in the case in which the upstream section 4' of the intake pipe 4 is open directly to the atmosphere, the electric circuit for the solenoid 28 may be opened and closed by a pressure-sensitive type switch actuator 40 which is shown in FIG. 3 and operative in response to a variation in pressure in the downstream section 5 of the intake pipe 4. The rest of the embodiment shown in FIG. 3 is identical to those of the embodiment shown in FIG. 2.

The volume control system of the present invention described above provides the following advantages:

Due to the use of the solenoids 27 and 28 as the actuators for the throttle valve 6 and the relief valve 19, the structure of the whole control system is greatly simplified and much inexpensive as compared with the control system in which a fluid pressure is used to operate such valves. In addition, since these solenoids can operate in quite a short time, the opening of the throttle valve 6 and the closing of the relief valve 19 can be finished almost instantaneously, so that the range of variation of the pressure in the tank 14 can be maintained substantially as small as the range set by the pressure-sensitive switch actuator 22. This assures not only a substantially constant pressure of compressed air at the delivery port of the tank 14 but also a reduced loss of power supply to the compressors 2 and 3.

Further, since the relief valve 19 and the throttle valve 6 are connected electrically only, the relief valve 19 can be located in the vicinity of the delivery pipe 11, so that the length of the pressure relief pipe 16 can considerably be reduced with a result that the flow resistance of the relief pipe 16 is remarkably reduced and that the volume of the relief pipe 16 is reduced. Accordingly, the air in the delivery pipe 11 and in the relief pipe 16 can be discharged through the relief valve 19 promptly when the latter is opened, so that the pressure in the delivery pipe 11 is immediately lowered to render the compressors 2 and 3 unloaded in a shortened time period. The reduced volumes of the relief pipe 16 and the delivery pipe 11 reduce the time required for the compressors to be rendered loaded when the relief valve 19 is closed, thereby to assure a prompt rise of the delivery pressure of the compressor 3. This also contributes to the reduction of loss of power supply to the compressors.

The prior art volume control system had a disadvantage that, when the operation of an associated compressor unit was changed over from a loaded operation to an unloaded operation, i.e., when the throttle valve is closed and the relief valve is opened, an unduly high pressure ratio is momentarily established between the low-pressure compressor and the high-pressure compressor 3 with a resultant rise of the temperature of the compressed air up to as high as some hundreds' degrees of centigrade thermometer because the air in the pipe 8, intercooler 9 and in the pipe 11 and relief pipe 16 is not quickly discharged. According to the control system of the invention, however, such a temperature rise can be avoided because the throttle and relief valves 6 and 19 are quickly operated to cause air in the relief pipe 16, delivery pipe 11, intercooler 9 and pipes 8 and 10 to be promptly discharged therefrom into the atmosphere and because the relief pipe 16 can be shortened to cause the volume of the relief pipe 16 and the delivery pipe 11 to be minimized.

What is claimed is:

1. In a compressor unit of the type that includes at least one rotary displacement compressor, an intake pipe, a throttle valve in said intake pipe, a tank for receiving and accumulating compressed gas, a delivery pipe extending between said compressor and said tank, a check valve in said delivery pipe, a pressure relief pipe connected at one end to said delivery pipe between said compressor and said check valve, and a pressure relief valve provided in said pressure relief pipe, an improved volume control system which comprises:

a first spring means operative to bias said throttle valve toward its closed position, a first solenoid means operative when energized to move said throttle valve to its fully open position against said first spring means, link means between said throttle valve and said first solenoid means, a second spring means operative to bias said pressure relief valve toward its fully open position, a second solenoid means operative when energized to move said pressure relief valve to its closed position against said second spring means, an electric circuit for said second solenoid, an electric switch in said electric circuit, and a switch actuator means responsive to changes of the positions of said throttle valve to actuate said electric switch, the arrangement being such that, when said throttle valve is moved to its closed position, said pressure relief valve is opened, and such that, when said throttle valve is moved to its open position, said pressure relief valve is closed.

2. The control system according to claim 1, wherein said switch actuator means comprises at least one link member operatively connected to said link means and operatively associated with said electric switch.

3. The control system according to claim 1, wherein said switch actuator means comprises a pneumatic actuator operatively associated with said electric switch and pneumatically connected to said intake pipe at points upstream and downstream of said throttle valve, said actuator being responsive to variation in the difference in pressure across said throttle valve to actuate said electric switch.

4. The control system according to claim 1, wherein said switch actuator means comprises a pneumatic actuator operatively associated with said electric switch and pneumatically connected to said intake pipe at a point downstream of said throttle valve, said actuator being responsive to variation in the pressure in said intake pipe downstream of said throttle valve to actuate said electric switch.

5. The control system according to claim 1, 2, 3 or 4, wherein said throttle valve has an outer peripheral edge which is spaced from the inner periphery of said intake pipe to define a gap therebetween.

* * * * *